United States Patent [19]

Walsh

[11] Patent Number: 4,707,632

[45] Date of Patent: Nov. 17, 1987

[54] ENERGY-EFFICIENT LAMP

[75] Inventor: Peter J. Walsh, Stirling, N.J.

[73] Assignee: Duro-Test Corporation, N. Bergen, N.J.

[21] Appl. No.: 816,387

[22] Filed: Jan. 6, 1986

Related U.S. Application Data

[63] Continuation of Ser. No. 445,214, Jan. 19, 1983, abandoned.

[51] Int. Cl.[4] ..... H01J 5/08; H01J 5/16; H01J 61/35; H01K 1/32

[52] U.S. Cl. ..... 313/112; 315/39

[58] Field of Search ..... 313/112, 113, 116, 110; 350/1.1, 1.6, 1.7, 162.17, 162.21, 162.23; 362/32; 315/39, 248

[56] References Cited

U.S. PATENT DOCUMENTS

| | | | |
|---|---|---|---|
| 2,932,581 | 4/1960 | Harkness et al. | 350/1.1 |
| 3,931,536 | 1/1976 | Fohl et al. | 313/116 |
| 4,080,545 | 3/1978 | Gallo | 313/113 |
| 4,160,929 | 7/1979 | Thorington et al. | 313/112 |
| 4,185,228 | 1/1980 | Regan | 315/248 X |
| 4,480,213 | 10/1984 | Lapatovich et al. | 315/248 |

FOREIGN PATENT DOCUMENTS

| | | | |
|---|---|---|---|
| 740470 | 4/1970 | Belgium | 350/1.1 |
| 54-33383 | 3/1979 | Japan | 313/113 |

OTHER PUBLICATIONS

*Phillips Technical Review*, vol. 26, No. 4/5/6, 1965, pp. 105–111, Groth R. and E. Kauer, "Thermal Insulation of Sodium Lamps".

*Applied Optics*, vol. 15, No. 3, Mar. 1976, pp. 761–767, Danielewicz, E. and P. Coleman, "Hybrid Metal Mesh-Dielectric Mirrors for Optically Pumped Far Infrared Lasers".

*Primary Examiner*—David K. Moore
*Assistant Examiner*—K. Wieder
*Attorney, Agent, or Firm*—Darby & Darby

[57] ABSTRACT

An energy-efficient lamp having a waveguide mounted to the envelope of the lamp which may be of the incandescent type. The waveguide passes visible radiation and reflects infrared radiation. The waveguide may be a reticulated layer of an electrically conductive material such as silver and the reticulations may be regularly or irregularly distributed over the surface of the envelope.

25 Claims, 11 Drawing Figures

ENERGY-EFFICIENT LAMP

This is a continuation of application Ser. No. 445,214, filed Jan. 19, 1983, now abandoned.

This invention pertains to electric lamps and methods for making them, and more particularly to electric lamps in which energy of a first predetermined range of wavelengths such as infrared, is returned to the site of lamp energy emission and energy of a second predetermined range of wavelengths, such as visible radiation, is transmitted out of the lamp.

U.S. Pat. No. 4,160,929, assigned to the assignee of the present invention, discloses an incandescent lamp in which a filter coating is placed on the envelope. This filter acts as a transparent heat mirror, i.e., as a mirror with a high reflectivity for infrared radiation and a low reflectivity for visible radiation. In such a lamp, the shape of the lamp envelope is selected so that infrared energy is reflected back to the filament to raise its operating temperature, thereby reducing the power needed to bring the filament to incandescence and thus increasing the lamp's efficiency.

Transparent heat mirrors may also be used advantageously in discharge lamps such as low pressure sodium vapor lamps. In such lamps there is no central filament to which infrared energy may be reflected; instead the entire volume of low pressure sodium vapor acts as the emission source. In these lamps all that is necessary is to trap the infrared energy which will then be reflected back into the volume containing the sodium vapor. In these lamps, it is not as difficult a matter to shape the heat mirror so that the infrared energy is reflected back to a selected location.

Filter coatings of the type disclosed in U.S. Pat. No. 4,160,929 have a minimum of three layers, each of which must be accurately controlled. In other lamps, coatings used for similar purposes, namely, behaving as a device that acts as a tranparent heat mirror for selectively reflecting and transmitting light in predetermined ranges, also require carefully controlled fabrication. It is thus necessary to subject the lamp envelope to a sequence of precisely controlled deposition operations in which the layers of the filter coating are laid down one by one.

It would be advantageous to provide a lamp utilizing such a selective heat mirror yet having a simpler construction than the prior art in which fewer deposition steps are needed. It would also be advantageous to provide a lamp of this type which would be more efficient than prior-art lamps. This is achieved in the present invention by mounting a waveguide in the lamp envelope. The waveguide is tuned to pass only visible and ultraviolet radiation. Thus, only visible and ultraviolet radiation can leave the lamp. Radiation of lower frequency cannot pass through the waveguide and therefore remains in the lamp. The shape of the envelope or other reflector is selected to reflect the infrared or other selected wavelengths back to the energy emission source. Where infrared energy is reflected back to the filament of an incandescent lamp, it raises the filament's operating temperature, thereby decreasing the amount of power needed to raise the filament to incandescence and thus increasing lamp efficiency.

In the lamp of the present invention, phase-shifting of incident radiation and resulting interference phenomena are eliminated or kept to a minimum by the waveguide structure. By using such a waveguide, it is unnecessary to provide a plurality of layers of films of various materials, such as in the prior art, since only one layer is deposited. The present invention may be advantageously utilized in incandescent and other lamps, such as, for example, sodium vapor lamps, in which generated infrared, or other selected wavelengths may be beneficially reflected back to the location of energy emission, raising the temperature thereof, and thereby increasing the lamp's efficiency.

It is an object of the invention to provide a lamp and method of making the same in which a waveguide means is mounted in the envelope to transmit selected wavelengths of energy produced by the lamp's energy emission source.

It is another object to provide such a lamp and method of fabrication thereof which requires fewer precisely-controlled deposition steps.

It is another object to provide a lamp which will provide less attenuation of visible light than that caused by the filter coatings of the prior art.

Other objects and advantages will become more apparent upon consideration of the following specification and annexed drawings in which:

DETAILED DESCRIPTION OF PREFERRED EMBODIMENTS

Figure 1:
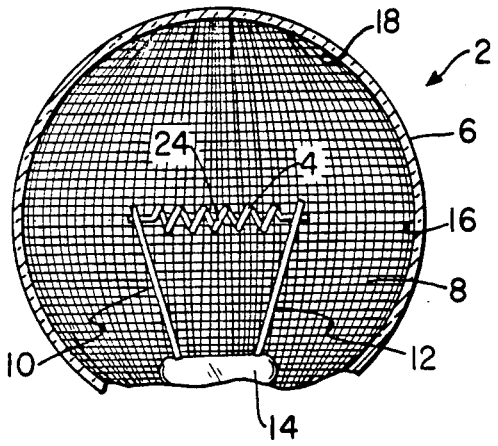
FIG. 1 is a partially cutaway view in an enlarged scale of an incandescent lamp in accordance with the invention.

A preferred embodiment of an incandescent lamp constructed according to the principles of the present invention is generally indicated by reference numeral 2. Lamp 2 in this example has an incandescent filament 4 which is contained within a sealed, generally spherical envelope 6. Other shapes of envelopes may be utilized. Although filament 4 is here shown as an elongated coil of tungsten, the configuration and material of filament 4 may be changed, and are not critical to the invention.

It will be appreciated by those skilled in the art that the invention is applicable to other types of lamps and other types of energy emission sources. For example, it is applicable to a sodium or other discharge lamp. As is explained in greater detail below, lamp 2 is selected from a type in which the energy emission source may benefit by interception of that portion of the energy reflected by waveguide 16 and/or which it is desired to trap a certain wavelength of energy at the envelope wall or within the lamp interior.

The interior 8 of envelope 2 may either be evacuated or filled with an inert gas. In the preferred embodiment, interior 8 is gas filled with an inert gas or inert gas mixture including nitrogen. Filament 4 is supplied with current through conductors 10 and 12, which are mounted to a reentrant stem 14 that extends into interior 8, and pass through stem 14 to a suitable base.

Figure 2:
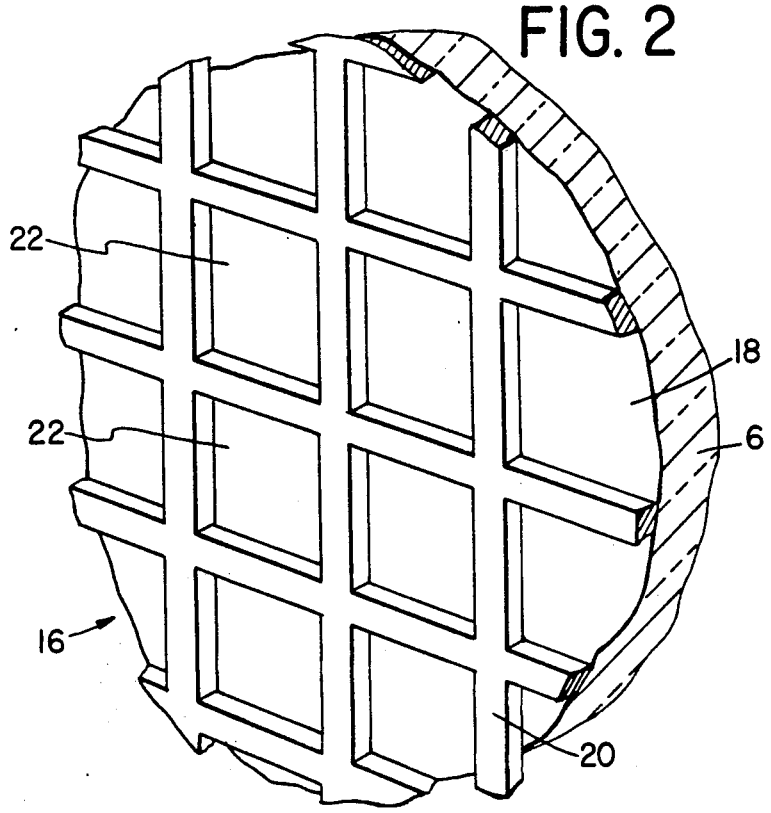
FIG. 2 is a still further enlarged view of a portion of FIG. 1.

A waveguide generally indicated by reflection numeral 16 and described in connection with FIG. 2 is located on the inner surface 18 of envelop 6. Waveguide 16 is designed such that only radiation having a wavelength less than a predetermined value, $\lambda_c$, can readily pass through it. Radiation having wavelengths greater than $\lambda_c$ are reflected.

Figure 3:
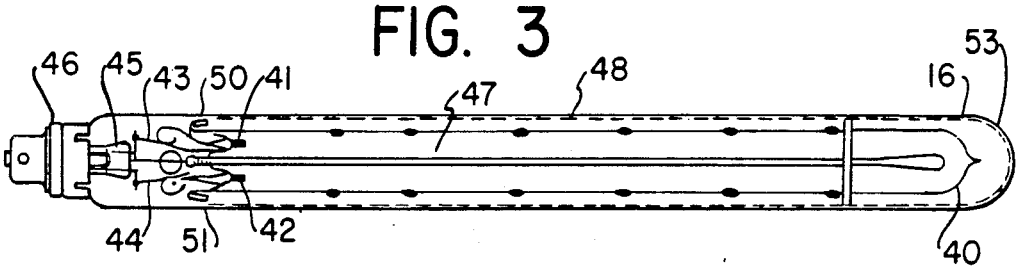
FIG. 3 is a view of another embodiment.

Refer now to FIG. 3 in which a low pressure sodium vapor discharge lamp is shown comprised of an inner U-shaped tube 40 having electrodes 41 and 42 located at the respective ends of the "U". Electrodes 41 and 42 are coupled by conductors 43 and 44 through reentrant stem 45 to base 46 to which an electric current may be applied. The interior 47 of U-shaped tube 40 will be filled with an inert gas which may be comprised of neon and argon with a small quantity of sodium vapor. As shown in FIG. 3, droplets 48 represent condensed droplets of free sodium. Seals 50 and 51 prevent escape of the neon-argon sodium mixture from U-shaped tube 40. The entire U-shaped tube with its associated electrodes and electrical couplings are housed within outer envelope 53 which is appropriately sealed to base 46. In such a lamp, waveguide 16, shown as a dashed line, may be attached to the interior of envelope 53.

In operation the initial application of current to base 46, which is coupled to electrodes 41 and 42, will ionize the neon and argon vapor within the U-shaped tube 40. As the ionized mixture heats, the free sodium droplets will vaporize increasing the sodium vapor pressure until that pressure is equal to the saturation vapor pressure corresponding to the temperature of the tube. Generally, the interior volume of envelope 53 will be evacuated to eliminate convection losses and reduce conduction losses. Waveguide 16 positioned on the interior of envelop 53 will minimize thermal radiation losses by reflecting infrared energy incident thereon back to the interior of envelope 53. The infrared radiation is thus trapped at the envelope and can aid in heating the vapor therein and thus reduce the amount of energy which is needed to be applied. It will also be recognized that waveguide 16 could be mounted on the outer surface of U-shaped tube 40 to similarly trap infrared radiation in the tube which will thus aid in heating the vapor therein.

Waveguide 16 comprises a reticulated layer 20 of a suitable highly electrically conductive metal, such as gold, silver or copper, deposited upon inner surface 18 of clamp 2. In the preferred embodiment, silver is utilized. Layer 20 has a multitude of square, rectangular or irregular reticulations 22 which are repeated throughout the overall extent of the waveguide in a substantially uniform pattern. The waveguide is located over all or a portion of the surface of the lamp envelope, depending upon the application for the lamp.

It can be shown that the maximum wavelength which can propagate through waveguide 16, when reticulations 22 are square or randomly oriented irregular shapes, is determined by two factors: the smallest dimensions of each reticulation 22 and the index of refraction of dielectric material that fills reticulation 22.

Each reticulation 22 and the part of layer 20 which immediately surrounds the reticulation can be considered a cell; each cell can be treated as flat because reticulations 22 are relatively small. Since each cell in the waveguide 16 can be treated as flat and the envelope 6 is spherical, reflection of incident radiation, whether caused by reflection off layer 20 or by the response of waveguide 16 is opposed to the direction of the radiation incident upon the waveguide. As a result, the reflected radiation is reflected directly back to form an image of the filament at the centerpoint 24 of lamp 2 (see FIG. 1).

The dimensions of reticulations 22, based upon present analyses, may be determined as follows. For simplicity in calculation, each reticulation is assumed to be square, having a unit length l on each side. It will be apparent to those skilled in the art, however, that reticulations of various shapes, sizes, and dimensions may be suitable for use in the present invention. Adjacent reticulations 22 are separated from one another by a barrier of the metal having a width dimension, w, such that the repeat distance "s" between corresponding edges of each reticulation is $s=l+w$. The grid surface is assumed to be substantially flat. The relative amount of open area, $A_O$, which is comprised of the areas of all of the reticulations 22, compared to the total cell area, $A_t$, which is the total area of the grid may be given as:

$$f_O=(A_O/A_t)=1-(w/s)^2 \tag{1}$$

The fraction of light incident on a barrier such as 23, $f_t=1-f_O$, is reflected by the barrier metal, which may be, for example, silver, having an assumed reflectivity coefficient of $r_g=0.94$. In the case where w equals s/4, $f_g$ will equal 0.062 and thus about 6 percent of the light will always be reflected. The remaining fraction of the light, $f_O$, will fall on reticulations such as 22.

The reticulations form a square wave guide of length t, where t is the thickness of layer 16. The light wave will transmit only a short distance through the material layer 16, for example, in the case of silver the light will be strongly attenuated within 100–200 Å of the metal surface. Therefore, through most of the depth of the reticulation, the light field will fall to zero in the barrier. Therefore, the light field goes to zero on the metal boundaries of the opening.

The wave vector can be given as:

$$k^2 = k_x^2 + k_y^2 + k_z^2 \text{ or} \tag{2}$$

$$\left(\frac{2\pi}{\lambda}\right)^2 = \left(\frac{2\pi}{\lambda_x}\right)^2 + \left(\frac{2\pi}{\lambda_y}\right)^2 + k_z^2$$

Where $\lambda=\lambda_o/n$, is the wavelength in the opening filled with a material whose index of refraction is n, and the subscripts x, y and z indicate the axes corresponding to the width, height and depth, respectively.

In the case of a square reticulation, the component of the electric field polarized parallel to one conducting wall must drop to zero at that wall, say at $x=1$, while the variation in the y direction is unaffected. Thus $$\lambda_x=\tfrac{1}{2} \tag{3}$$

$k_z$ may then be solved to obtain:

$$k_z = 2\pi\left[\left(\frac{n}{\lambda_o}\right)^2 - \left(\frac{1}{1^2}\right)\right]^{\frac{1}{2}} \tag{4}$$

The cut-off wavelength, $\lambda_c$, then requires k to become equal to zero. Therefore, $$\lambda_c=n1 \tag{5}$$

When $\lambda_o$ is $<\lambda_c$, k is real and there is a wave propagation in the Z direction with a wavelength $$\frac{1}{\lambda_z} = \left[\left(\frac{n}{\lambda_o}\right)^2 - \frac{1}{1^2}\right]^{\frac{1}{2}} = \left[\frac{n^2}{\lambda_o} - \left(\frac{n}{\lambda_c}\right)^2\right]^{\frac{1}{2}} \quad (6)$$

The opening therefore behaves as if it has and index of refraction $n_1$ given by $\lambda_z$ equivalent to $\lambda_o/n_1$, or for $\lambda_o<\lambda_c$, $$n_1 = n\left[1 - \frac{\lambda_o^2}{\lambda_c}\right]^{\frac{1}{2}} \quad (7)$$

When $\lambda_o>\lambda_c$, k is complex and only an exponentially damped solution is allowed in the Z direction. There is a corresponding complex part to the index given by ik equivalent to $ik_1\ 2/\lambda_o$, with $k_1$ as a damping coefficient whose value is:

$$k_1 = n\left(\frac{\lambda_o}{\lambda_c}\right)\left[1 - \left(\frac{\lambda_c}{\lambda_o}\right)^2\right]^{\frac{1}{2}} \quad (8)$$

Therefore, at wavelengths less than $\lambda_c$, the opening x has a pure dielectric of index $n_1$, while above cut-off the opening acts like a pure metal of imaginary index of reflexion $ik_1$. In neither case is there any loss. Waveguides composed of silver, for example, will always have less losses than a silver film of similar optical properties.

A grid filter deposited on glass can be treated as a thin film on glass having an index for the film given by either equations (7) or (8). Standard formula may be used to obtain reflectivity, $R_o$, and transmissivity, $T_o$, of the opening. The overall reflectivity and transmissivity of the grid filter are then given by the following:

$$R_f = f_g R_g + f_o R_o$$

$$T_f = f_o R_o \quad (9)$$

In one example of the invention, $\lambda_c=0.85$ micrometers, which is just above the reddest visible red, thus waveguide means 16 permits substantially all visible radiation to leave lamp 2.

In this example, layer 20 is 0.41 micrometers thick, reticulations 22 are 0.425 micrometers square, and adjacent reticulations 22 are separated from each other by a silver barrier which is 0.13 micrometers wide.

With the dimensions listed above, radiation from incandescent filament 4 (or other light-emitting means) will only pass through waveguide means 16 if such radiation has a wavelength of 0.85 micrometers. Thus, infrared radiation cannot pass through recticulations 22 and is strongly reflected. In other words, at wavelengths which are shorter than 0.85 micrometers, waveguide 16 acts like a pure dielectric, while at wavelengths which are longer than 0.85 micrometers, waveguide 16 acts like a pure metal. The characteristics of waveguide 16 may alternatively be adjusted by shifting the longest transmitted wavelength towards the visible part of the spectrum, i.e. to about 0.78 micrometers which is still in the red. Since pure metals and pure dielectrics are substantially non-absorbing, there is practically no loss of radiation by absorption.

Figure 4:
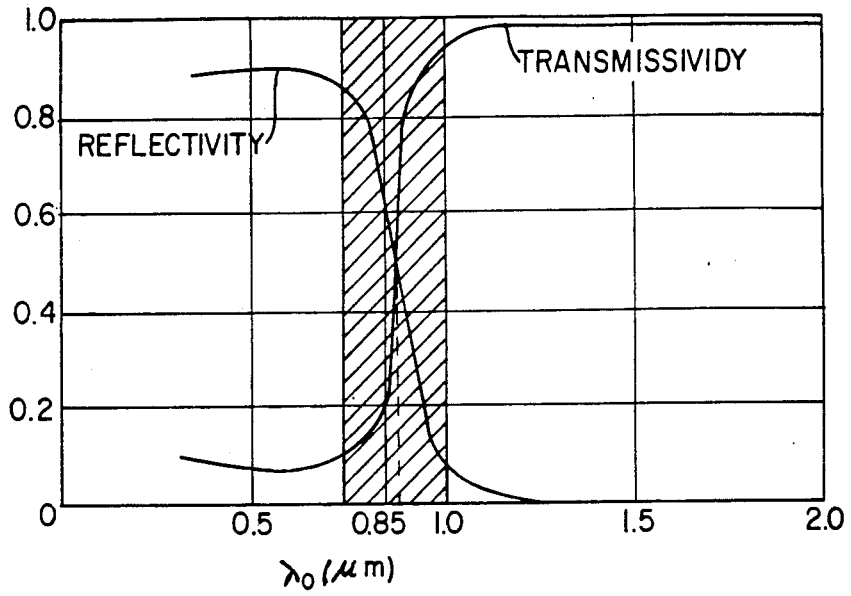
FIG. 4 is a graph useful in explaining the invention illustrating the transmission and reflection characteristics of the waveguide.

Calculation has shown that the overall transmissivity and reflectivity of waveguide 16 are substantially as shown in FIG. 4. While the thickness of layer 20 does not greatly affect $\lambda_c$, it does affect the response of waveguide 16 in the region of $\lambda_c$, i.e., in the vicinity of the shaded region in FIG. 4. The thinner layer 20, the more gradual will be the change in transmission characteristics in the region of $\lambda_c$ with changes in wavelength.

It will be understood that the site or sites to which radiation is reflected will depend upon the shape of the envelope 6, and will be chosen in accordance with whatever light-emitting source is selected. Thus, if envelope 6 is elliptical and lamp 2 is of the discharge type, reflected radiation will be directed mainly between the foci of the envelope 6 and these foci may be located at the lamp's electrodes so that the return radiation illuminates the discharge volume. Similarly, if the source is a linear filament, the foci should be located just inside the ends of the filament.

Figure 6:
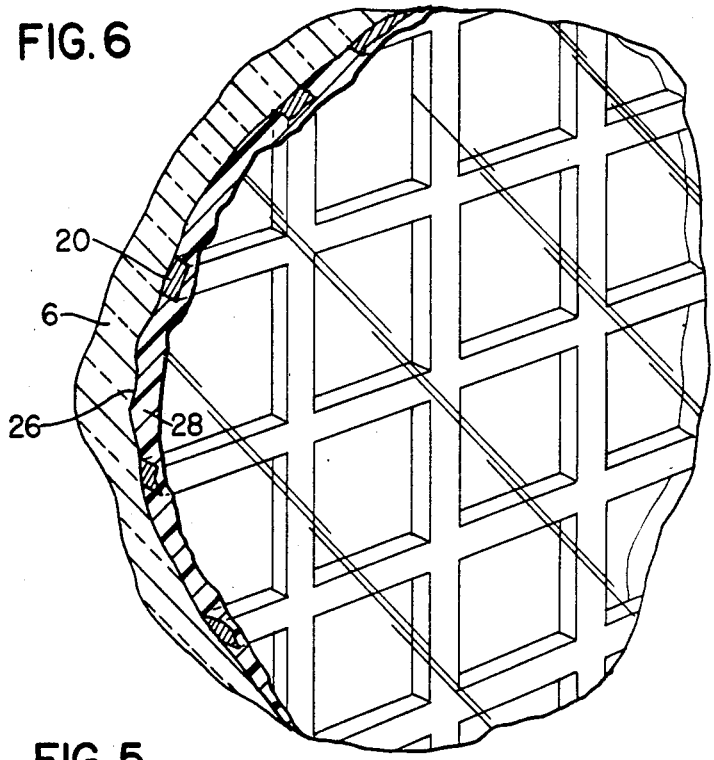
FIG. 6 is an enlarged view of another embodiment.
Figure 5:
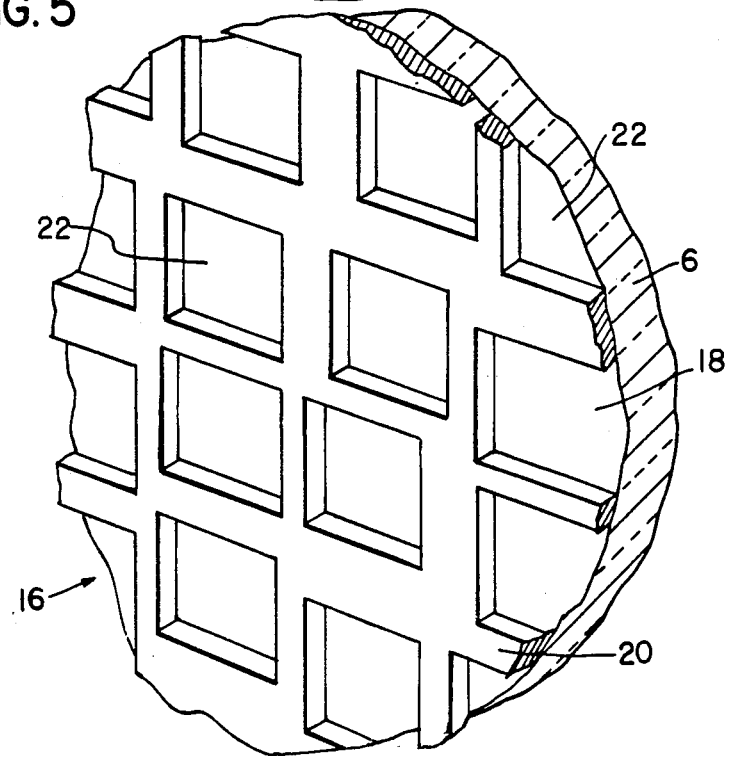
FIG. 5 is an enlarged view of one embodiment.

When the surface area of one reticulation 22 is compared with the surface area of one reticulation cell and the reticulations are placed in a periodic manner, as discussed hereinabove, a small portion of the visible radiation will always be reflected back. This is disadvantageous since some visible radiation would be reflected back to the source near centerpoint 24 without ever passing out of the lamp. In order to further increase the efficiency of lamp 2, reticulations 22 may still be of a uniform size but slightly non-periodic, i.e., can be irregularly distributed over the inner surface 18 of envelope 6 as shown in FIG. 6). In such manner, reflected visible radiation (which only reflects off layer 20) will spread out by diffraction accompanying the irregular location of reticulations 22 and will miss the central source, such as filament 4, and can eventually pass out of lamp 2, whether directly or after one or more further reflections off waveguide means 16. The infrared radiation, on the other hand, will be unaffected by the irregularities in the location of reticulations 22, and will thus be returned directly to centerpoint 24.

Since the reflectivity beyond $\lambda_c$ is high from both the metal latice and from the opening, the non-periodic nature of the lattice does not affect the reflected infrared radiation which remains accurately focused for a sufficiently smooth and properly shaped envelope 6.

In this example, filament 4 (or other light-emitting source) is shown to pass through centerpoint 24. This is preferred because the infrared radiation will thus be made incident upon filament 4. Materials other than silver suitable for layer 20 include copper, gold, aluminum, and heavily doped semiconductors such as indium tin oxide.

Figure 7:
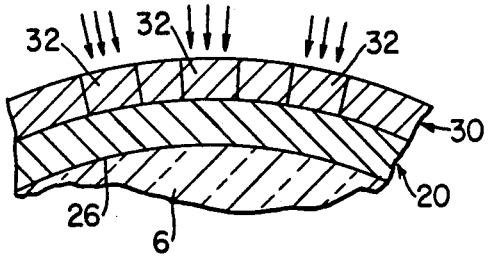
FIGS. 7–11 illustrate a method of fabricating the lamp.

If waveguide 16 is to be located on outer surface 26 of envelope 6, it is advantageous to fill reticulations 22 with dielectric material 28 (see FIG. 7). Suitable dielectric materials include glasses, plastics, and titanium dioxide. In this example, dielectric material 28 can be a single layer having reticular protrusions which correspond to reticulations 22. This has the advantage that dielectric material 28 overlies layer 20 and forms a protective overcoat.

Although reticulations 22 are here shown as square, they do not need to be square and can be either regular or irregular without departing from the invention. Furthermore, reticulations 22 can be regularly or irregularly spaced on outer surface 26, and layer 22 need not be silver but may be instead one of the alternative materials previously listed.

The method of the invention illustrated in FIGS. 8–12 is applied to outer surface 26 of envelope 6 but is equally applicable to inner surface 18 thereof. In this method, a uniform layer 20 of, silver or other material as discussed hereinabove, is laid down as by evaporation, chemical vapor deposition, sputtering, or other technique. After the proper thickness of layer 20 has been laid down, deposition ceases.

Next, a positive photoresist 30 is deposited upon layer 20. Photoresist 30 is responsive to exposing radiation, which in this case may be 0.1850 micrometer mercury illumination or any other illumination with a wavelength sufficiently small that reticulations 22 can be accurately exposed. X-ray or electron beam lithography techniques may also be suitable. Regions 32 of photoresist 30 are exposed, while regions 34 are not.

Figure 9:
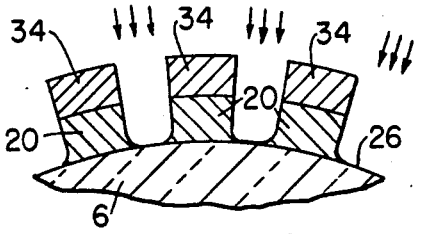

After such exposure, the photoresist is developed and chemically washed in accordance with techniques known in the art of integrated circuit manufacture (FIG. 9). The exposed region 32 of the positive photoresist 30 will, after development and washing, be dissolved away. The unexposed regions 34 of photoresist 30 will remain on layer 20.

Figure 10:
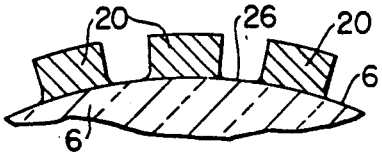
Figure 8:
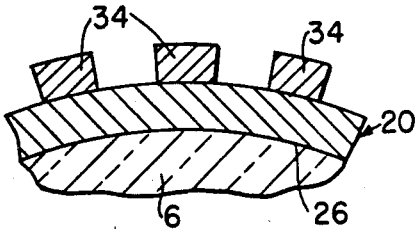
Figure 11:
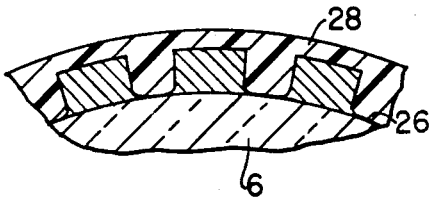

After development and washing of photoresist 30, layer 20 may be etched as by acid or by bombardment with ions in accordance with techniques also known in the art of semiconductor manufacture (FIG. 10). Thereafter, regions 34 of photoresist 30 may be washed away using a suitable chemical solvent (FIG. 11). What remains is a reticulated layer 20 of silver. In this example, a layer of dielectric 28 may be laid down to fill reticulations 22 in layer 20 and to provide the protective overcoat described above (FIG. 12). If this method is used to mount the waveguide means 16 to the inner surface 18 of envelope 6, this last step may be omitted.

It will be understood that a negative photoresist can be used instead of a positive photoresist as long as the exposure and etching techniques are correspondingly changed.

It is also possible to form a reticulated layer in accordance with a technique set forth by Craighead, Howard and Tennant in Appl. Phys. Let. 38(2), 15 Jan. 1981, at p. 75. In this technique, islands of metal are caused to grow at discrete sites. By interrupting the growth of a layer of metal in an incomplete state, an incompletely grown (and thus effectively reticulated) layer is created.

I claim:

1. An energy-efficient lamp comprising:

an at least partially transparent envelope:

means within said envelope for generating electromagnetic radiation having wavelengths in a predetermined range consisting essentially of visible and infrared radiation upon the application of energy thereto;

waveguide means for substantially reflecting back to said electromagnetic radiation generating means portions of said electromagnetic radiation having wavelengths greater than a predetermined wavelength intermediate said visible and infrared radiation and for substantially transmitting therethrough electromagnetic radiation having wavelengths less than said predetermined wavelength, said waveguide means comprising a plurality of cells for guiding electromagnetic radiation therealong in a predetermined direction of propagation said cells having a predetermined cross-sectional shape perpendicular to said direction of propagation, each cell having a transmission opening with cross-sectional dimensions which are on the order of said predetermined wvelength, said cell opening essentially losslessly guiding radiation of wavelengths less than said predetermined wavelength and essentially losslessly reflecting radiation of wavelengths greater than said predetermined wavelength; and a dielectric substance within said cell openings.

2. The lamp according to claim 1 wherein said waveguide means comprises a reticulated electrically conductive structure in which each cell is formed by a reticulation.

3. The lamp according to claim 2 wherein said reticulations are periodically disposed.

4. The lamp according to claim 2 wherein said reticulations are disposed aperiodically.

5. The lamp according to claim 3 wherein said lattice is fabricated from a material selected from the group consisting of silver, copper, gold, aluminium and heavily doped semiconductors.

6. The lamp according to claim 3 wherein said reticulations are substantially square in cross-section.

7. The lamp according to claim 3 further comprising a dielectric material filling said reticulations.

8. The lamp according to to claim 7 wherein said dielectric material is a single layer having protrusions corresponding to said reticulations.

9. The lamp according to claim 2 wherein said waveguide means is mounted to an inner surface of said envelope.

10. The lamp according to claims 3 wherein said waveguide means is mounted on an outer surface of said envelope.

11. The lamp according to claim 8 wherein said waveguide means is mounted on an outer surface of said envelope and said single layer of dielectric forms a protective coating.

12. The lamp according to claims 3 wherein said predetermined wavelength is 0.85 micrometers.

13. The lamp according to claim 1 wherein said electromagnetic radiation generating means comprises an incandescent filament.

14. The lamp according to claim 1 wherein said lamp is a gas discharge lamp.

15. The lamp according to claim 14 wherein said gas discharge lamp is a sodium vapor lamp.

16. The lamp according to claim 3 wherein said envelope and said waveguide means are substantialy spherical and said electromagnetic generating means is disposed at the center of said sphere.

17. An energy-efficient lamp comprising:

a substantially spherical envelope;

an incandescent filament disposed substantially at the center of said spherical envelope for pdocucing upon incandescence light in the infrared and visible range;

a waveguide comprised of a reticulated silver coating on the interior of said envelope wherein said reticulations are substantially square in a cross-section and a periodically spaced, the cross-sectional dimensions of said reticulations being chosen to be equal to a predetermined wavelength intermediate the visible and infrared light to transmit said visible light and reflect said infrared light and wherein said waveguide means is disposed such that said infrared light is reflected back to said filament; and a dielectric substance within said reticulations.

18. The lamp according to claim 17 wherein said reticulated silver coating is on the exterior of said envelope and is protected by a dielectric coating thereon.

19. An energy efficient sodium vapor lamp comprising:

an outer envelope;

an inner envelope containing first and second electrodes, said inner envelope further including sodium vapor wherein said sodium vapor generates visible and infrared light upon the application of electrical current to said first and second electrodes;

a waveguide comprised of a reticulated coating of highly conductive material on said outer envelope, wherein said reticulations are substantially square in cross-section and a periodically spaced, the cross-sectional dimensions of said reticulations being chosen to be equal to a predetermined wavelength intermediate said visible and infrared light to transmit said visible light and reflect infrared light and wherein said waveguide means is disposed such that said infrared light is trapped within the interior of said envelope; and a dielectric substance within said reticulations.

20. A lamp according to claim 19 wherein said waveguide is disposed on the interior of said envelope.

21. The lamp according to claim 19 wherein said waveguide is disposed on the exterior of said envelope and further includes a protective dielectric coating thereon.

22. The lamp according to claim 19 wherein said waveguide is disposed on the inner envelope.

23. The lamp according to claim 19 wherein said inner envelope further includes neon and argon gases.

24. The lamp according to claim 23 wherein the space between said inner and outer envelopes is substantially a vacuum.

25. The lamp according to claim 24 wherein said highly conductive coating is comprised of materials selected from the group of silver, gold and highly doped semiconductors.

* * * * *